US009474352B2

(12) United States Patent
Hangai et al.

(10) Patent No.: US 9,474,352 B2
(45) Date of Patent: Oct. 25, 2016

(54) MASCARA BRUSH AND MANUFACTURING METHOD THEREOF

(71) Applicant: SHINOHARA Co., Ltd., Itabashi-ku, Tokyo (JP)

(72) Inventors: Ryuichi Hangai, Tokyo (JP); Yasushi Uchiyama, Tokyo (JP)

(73) Assignee: SHINOHARA Co., Ltd., Tokyo (JP)

( * ) Notice: Subject to any disclaimer, the term of this patent is extended or adjusted under 35 U.S.C. 154(b) by 0 days.

(21) Appl. No.: 14/129,032

(22) PCT Filed: Dec. 7, 2012

(86) PCT No.: PCT/JP2012/081758

§ 371 (c)(1),
(2) Date: Dec. 23, 2013

(87) PCT Pub. No.: WO2014/087534

PCT Pub. Date: Jun. 12, 2014

(65) Prior Publication Data

US 2014/0251367 A1 Sep. 11, 2014

(51) Int. Cl.
*A45D 40/26* (2006.01)
*A46B 3/18* (2006.01)
(Continued)

(52) U.S. Cl.
CPC ..... *A45D 40/262* (2013.01); *A46B 3/18* (2013.01); *A46B 9/021* (2013.01); *A45D 40/265* (2013.01); *A46D 3/05* (2013.01)

(58) Field of Classification Search
CPC ..... A45D 40/262; A46B 9/021; A46B 3/18
USPC ..... 132/218, 317, 320
See application file for complete search history.

(56) References Cited

U.S. PATENT DOCUMENTS 5,345,644 A * 9/1994 Gueret ..... 15/160
2004/0168698 A1* 9/2004 Gueret ..... 132/200
(Continued)

FOREIGN PATENT DOCUMENTS

JP 4884156 U 10/1973
JP 05-228018 A 9/1993
JP 06209825 A 8/1994
(Continued)

OTHER PUBLICATIONS

Notice of Reasons for Refusal, dated Nov. 4, 2014, issued in corresponding JP Application No. 2013-547427, 7 pages in English and Japanese.

*Primary Examiner* — Rachel Steitz
(74) *Attorney, Agent, or Firm* — Sughrue Mion, PLLC

(57) ABSTRACT

The present invention relates to a mascara brush for applying a mascara liquid to eyelashes and a manufacturing method thereof, including a first step to fix to a core member many first brush bristles and many second brush bristles having softening point temperatures lower than those of the first brush bristles in a state where the first brush bristles and the second brush bristles are mixed with each other and extend radially, where while bending at least a partial area in a direction encircling the core member of the first brush bristles and the second brush bristles at intermediate positions in extending from the core member, subjecting the first brush bristles and the second brush bristles to an atmosphere of a temperature lower than the softening point temperatures of the first brush bristles and higher than the softening point temperatures of the second brush bristles.

7 Claims, 8 Drawing Sheets

(51) Int. Cl.
*A46B 9/02* (2006.01)
*A46D 3/05* (2006.01)

(56) References Cited

U.S. PATENT DOCUMENTS

| | | | | |
|---|---|---|---|---|
| 2004/0240926 | A1* | 12/2004 | Gueret | 401/122 |
| 2009/0014022 | A1 | 1/2009 | Salciarini | |

FOREIGN PATENT DOCUMENTS

| | | | |
|---|---|---|---|
| JP | 2003-189930 | A | 7/2003 |
| JP | 2004237098 | A | 8/2004 |
| JP | 2007006951 | A | 1/2007 |
| JP | 2008-012357 | A | 1/2008 |
| JP | 2010533018 | A | 10/2010 |
| JP | 2012503523 | A | 2/2012 |
| WO | 2010036577 | A2 | 4/2010 |

* cited by examiner

MASCARA BRUSH AND MANUFACTURING METHOD THEREOF

CROSS REFERENCE TO RELATED APPLICATIONS

This application is a National Stage of International Application No. PCT/JP2012/081758, filed on Dec. 7, 2012, the contents of all of which are incorporated herein by reference in their entirety.

TECHNICAL FIELD

The present invention relates a mascara brush (mascara wand) to apply a mascara liquid to eyelashes and a manufacturing method thereof.

BACKGROUND ART

A conventional mascara brushes has a straight core member and many brush bristles being fixed to the core member and extending radially. When the many bristles are not subjected to special processing, they have shapes extending radially from the core member in an orderly manner. On the other hand, since liquid retainability of a mascara liquid is determined by wettability of surfaces of brush bristles and the surface tension of the mascara liquid itself, the mascara liquid may flow fluently but the liquid retainability may be poor even only when the brush bristles are just arranged in the orderly manner. If the liquid retainability is poor, there is a possibility in which a large amount of the mascara liquid retained in the mascara brush transfers to eyelashes at a time, and solidly filling may occur or a liquid drop lump may be produced and so on, and thus, satisfactory finishing may be hardly accomplished. In addition, if the liquid retainability is poor, it is required to add the liquid at frequent intervals, causing makeup with the mascara to be difficult.

On the other hand, when the brush bristles is processed through only taking the liquid retainability into consideration, the eyelashes are hardly allowed to sufficiently enter the inside of the brush, an amount of the mascara liquid applied to the eyelashes is decreased, and thus, so-called catch-up feel of wrapping and holding eyelashes and so-called volume-up effect of voluming eyelashes up may not be sufficiently provided. Accordingly, a mascara brush is required to satisfy both of sufficient catch-up feel and sufficient volume-up effect.

For obtaining both of them, PTL 1 proposes mixing two kinds of brush bristles having melting temperatures different from each other, melting tips of the brush bristles having the low melting temperature to make brush bristles having short lengths and forming lumps whose diameters larger than those of the brush bristles at the tips of the brush bristles. If this is accomplished well, it may be possible to satisfy both of sufficient catch-up feel and sufficient volume-up effect.

In addition, PTL 2 proposes heating and bending the brush bristles at the plural areas in circumferential directions around the core member to ensure the liquid retainability by the brush bristles, thereby obtaining the catch-up feel and the like at boundary areas between the bent brush bristles and brush bristles extending long without being bent.

CITATION LIST

Patent Literature

PTL 1: Japanese Laid-open Patent Publication No. 5-228018
PTL 2: Laid-open Patent Publication No. 2003-189930

SUMMARY OF INVENTION

Technical Problem

Here, the proposal described in PTL1 of melting the tips of the brush bristles having the lower melting temperature to form the ball-shaped bumps at the tips of the brush bristles is not practical, since even though the tips of the brush bristles are intended to be melt, the brush bristles may be melt without stopping up to root portions thereof fixed to the core member, and there may be a mixture in which some of the brush bristles may be melt earlier and some of the brush bristles hardly start to be melt due to delicate distance differences between a heat source and the tips of the brush bristles, the temperature distribution and the like, and thus it is so difficult to form appropriate lumps while keeping the lengths of the brush bristles to be adequate.

In addition, the proposal described in PTL2 of heating and bending the brush bristles at the plural areas in the circumferential direction around the core member has been succeeded to some extent in satisfying the liquid retainability, the catch-up feel and the like together. However, since the roles in the circumferential direction are shared, a user is concerned about an angle in the circumferential direction when contacting the mascara brush on the user's eyelashes, and the user first allows the eyelashes to enter deep the brush bristles at areas in which the brush bristles are not bent, and allows the eyelashes to be contacted at the area where the brush bristles are bent while rotating the brush, and so the user required to use the mascara brush while adjusting the angle, and thus, the usability may not be sufficiently good.

In view of the foregoing circumstances, it is an object according to an aspect of the present invention to provide a mascara brush whose usability is good while satisfying the liquid retainability, a good catch-up feel and the like together.

Technical Solution

A mascara brush according to the present invention to obtain the above-described object, includes:

a core member;

a first plurality of brush bristles which are fixed to the core member and radially extend from the core member;

a second plurality of brush bristles each of which has the softening point temperature lower than that of each of the first plurality of brush bristles, which are fixed to the core member to be mixed with the first plurality of the brush bristles, and which include at least a portion radially extending up to intermediate points thereof from the core member and bending at intermediate positions thereof.

In the mascara brush according to the present invention, since the at least the portion of the second brush bristles is bent, the liquid retainability is ensured, and further, the first brush bristles stand up at any position in the circumferential direction encircling the core member, eyelashes easily enter deep the brush bristles. The eyelashes entering the depth of the brush bristles enters a state of being pinched between the first brush bristles extending radially and the bent second brush bristles, the good catch-up feel is obtained. In addition, according to the mascara brush according to the first aspect of the present invention, a mascara brush whose usability is good and which basically is not required to care an angle in the circumferential direction around the brush is obtained.

Here, in the mascara brush according to the present invention, it is preferable that the first plurality of the brush bristles are made of fluorine-based resin, and is preferable that the second plurality of brush bristles are made of polyamide or polybutylene terephthalate.

As for the fluorine-based resin, it is easy to choose a resin made of fluorine-based resin which has a softening point temperature in which after the resin is bent and heated the resin returns to its original shape, and as for the polyamide or the polybutylene terephthalate, it is easy to choose a resin made of polyamide or polybutylene terephthalate in which after the resin is heated to be bent the bent shape is maintained, and thus they are suitable for a mascara brush according to the present invention.

In addition, a manufacturing method according to the present invention, includes:

a first step including fixing to a core member a first plurality of brush bristles and a second plurality of brush bristles each having the softening point temperature lower than that of each of the first plurality of brush bristles such that the first plurality of brush bristles and the second plurality of brush bristles are mixed with each other and the first plurality of brush bristles and the second plurality of brush bristles radially extend; and a second step including, while bending at least a partial area in a circumferential direction encircling around the core member of the first plurality of brush bristles and the second plurality of brush bristles at intermediate positions, subjecting the first plurality of brush bristles and the second plurality of brush bristles to an atmosphere of a temperature which is lower than the softening point temperature of each of the first plurality of brush bristles and higher than the softening point temperature of each of the plurality of second brush bristles.

In the manufacturing method of mascara brush according to the present invention, the first brush bristles and the second brush bristles whose softening point temperatures are different form each other are mixed together and both of the first and second brush bristles are bent and heated and thereby only the second brush bristles having the lower softening point temperature are softened to be bent, and thus, a practical manufacturing method of a mascara brush is obtained in which the controlling thereof is easily performed and further, the mascara brush satisfies simultaneously both of the sufficient catch-up feel and the sufficient volume-up effect and provides ease of use.

Here, in the manufacturing method of mascara brush according to the present invention, it is acceptable that the first step includes holding the first plurality of brush bristles and the second plurality of brush bristles between the two pieces of wires in a state in which the first plurality of brush bristles and the second plurality of brush bristles are mixed and aligned in parallel, and twisting the two pieces of wires to fix the first plurality of brush bristles and the second plurality of brush bristles in a spiral arrangement around the core member formed by the two pieces of wires in the twisted state.

Conventionally, for mascara brushes, a method of manufacturing in which brush bristles are held between two pieces of metal wires and the two pieces of metal wires are twisted has been used, the manufacturing method of mascara brush according to the present invention is consistent with such conventional manufacturing method.

Advantageous Effects

As described above, according to the present invention, a mascara brush in which both of the sufficient catch-up feel and the sufficient volume-up effect are satisfied simultaneously and whose usability is satisfactory is obtained, and also it is possible to practically manufacture the mascara brush.

BEST MODE FOR CARRYING OUT THE INVENTION

In the followings, embodiments according to the present invention will be described.

Figure 1:
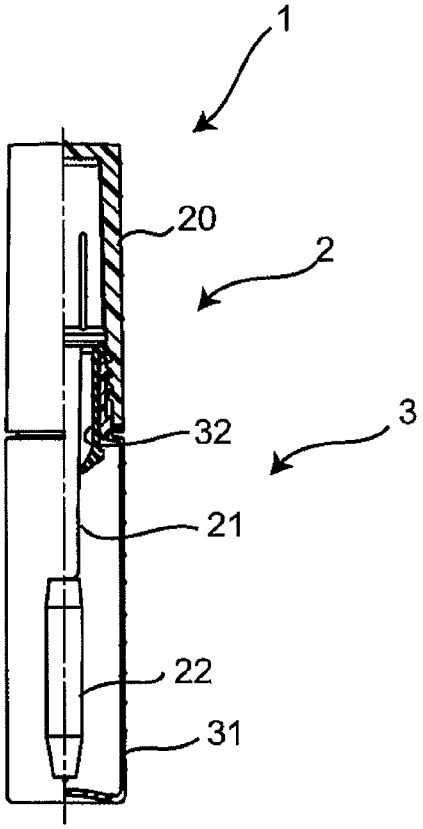
FIG. 1 is a view illustrating an example of mascara applicator including an embodiment of the mascara brush according to the present invention.

FIG. 1 is a view illustrating an example of mascara applicator including an embodiment of the mascara brush according to the present invention.

Figure 2:
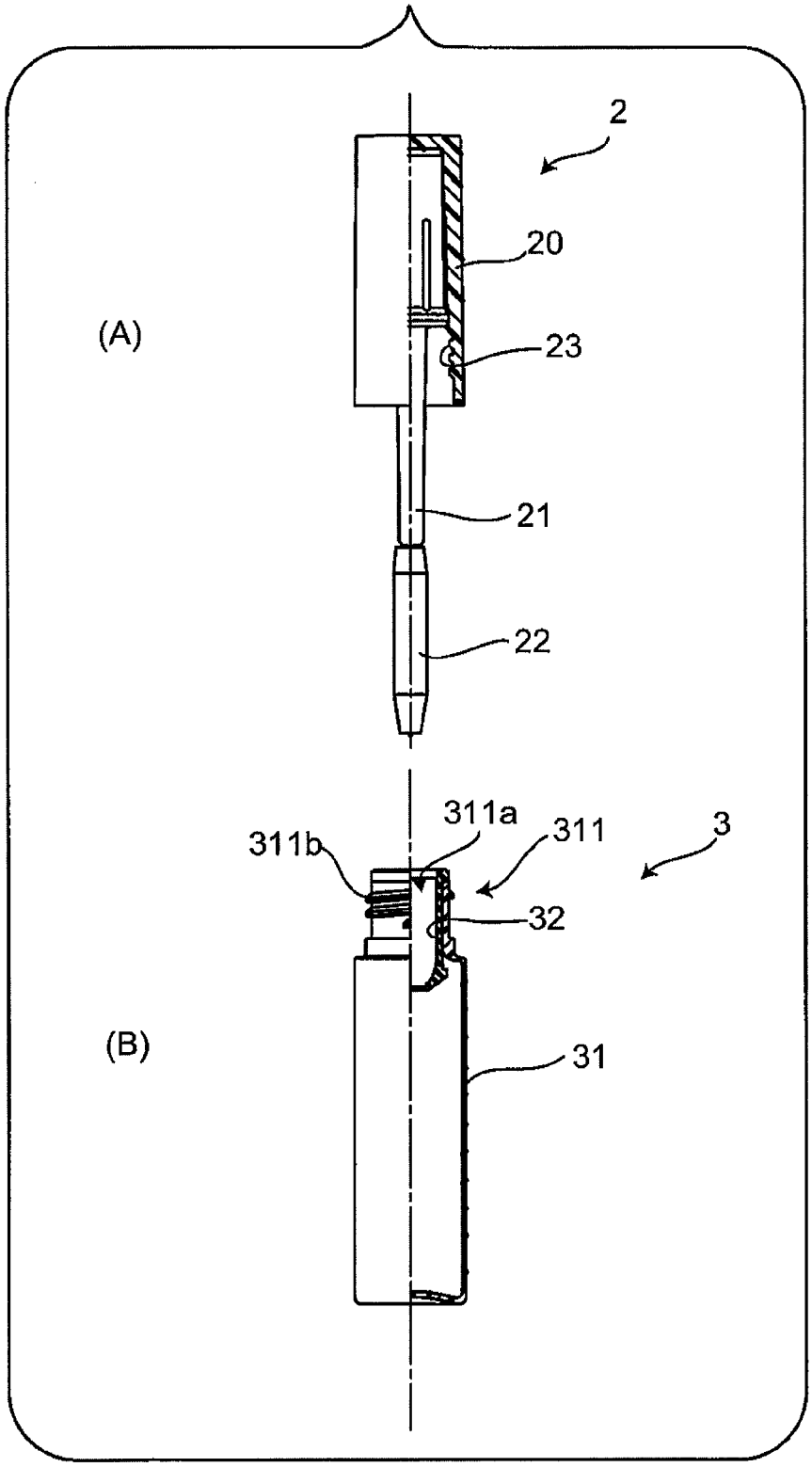
FIG. 2 is a view illustrating the mascara applicator illustrated in FIG. 1 divided into a case (a mascara tube) and a cap.

In addition, FIG. 2 is a view illustrating the mascara applicator illustrated in FIG. 1 divided into a case and a cap.

In these FIGS. 1 and 2, left halves represent external appearances, and right halves represent vertical cross sections, respectively.

As illustrated in FIG. 2, this mascara applicator 1 includes a cap 2 and a case 3. Here, the case 3 will be described first.

The case 3 includes a case main body 31 made of, for example, plastic, and a squeezing member 32.

The case main body 31 includes an opening section 311 including an opening 311*a* continuing to the inside of the case main body 31. A male screw 311*b* is formed on an outer circumferential surface of the opening section 311. The squeezing member 32 fits in the opening section 311. The squeezing member 32 has an approximately cylindrical shape, and a lower end of the squeezing member 32 is deflated. In addition, an upper end of the squeezing member 32 is slightly protruded outward, and when the squeezing member 32 is fitted in the opening 311*a* of the case main body 31, the squeezing member 32 is put on an edge of the upper end edge of the opening section 311.

Since the squeezing member 32 has the approximately cylindrical shape and a through hole formed therewith, the case 3 including the case main body 31 and the squeezing member 32 also includes the opening 311*a*.

The cap 2 includes a cap main body 20 made of plastic, a shaft 21 to extend inside the case 3 and a brush 22 fixed to a tip of the shaft 21. The cap 2 includes a female screw 23 to be mated with the male screw 311*b* of the case 3, and the shaft 21 is supported by the cap main body 20 further deep than the female screw 23.

When the cap 2 is attached to the case 3, as illustrated in FIG. 1, the brush 22 is accommodated on a further deep side than the squeezing member 32 inside the case 3. A mascara liquid is contained in the case 3, and the mascara liquid in the case 3 sticks to the brush 22. When the cap 2 is removed from the case 3, the brush 22 rubs against the deflated portion in the lower end of the squeezing member 32 and thus, a portion of the mascara liquid stuck to the brush 22 is returned to the case 3, and the brush 22 in a state of being stuck with an appropriate amount of the mascara liquid is take out of the case 3. Then, by putting the brush 22 on eyelashes while holding the cap main body 20, the mascara liquid stuck to the brush 22 is applied to the eyelashes.

Figure 3:
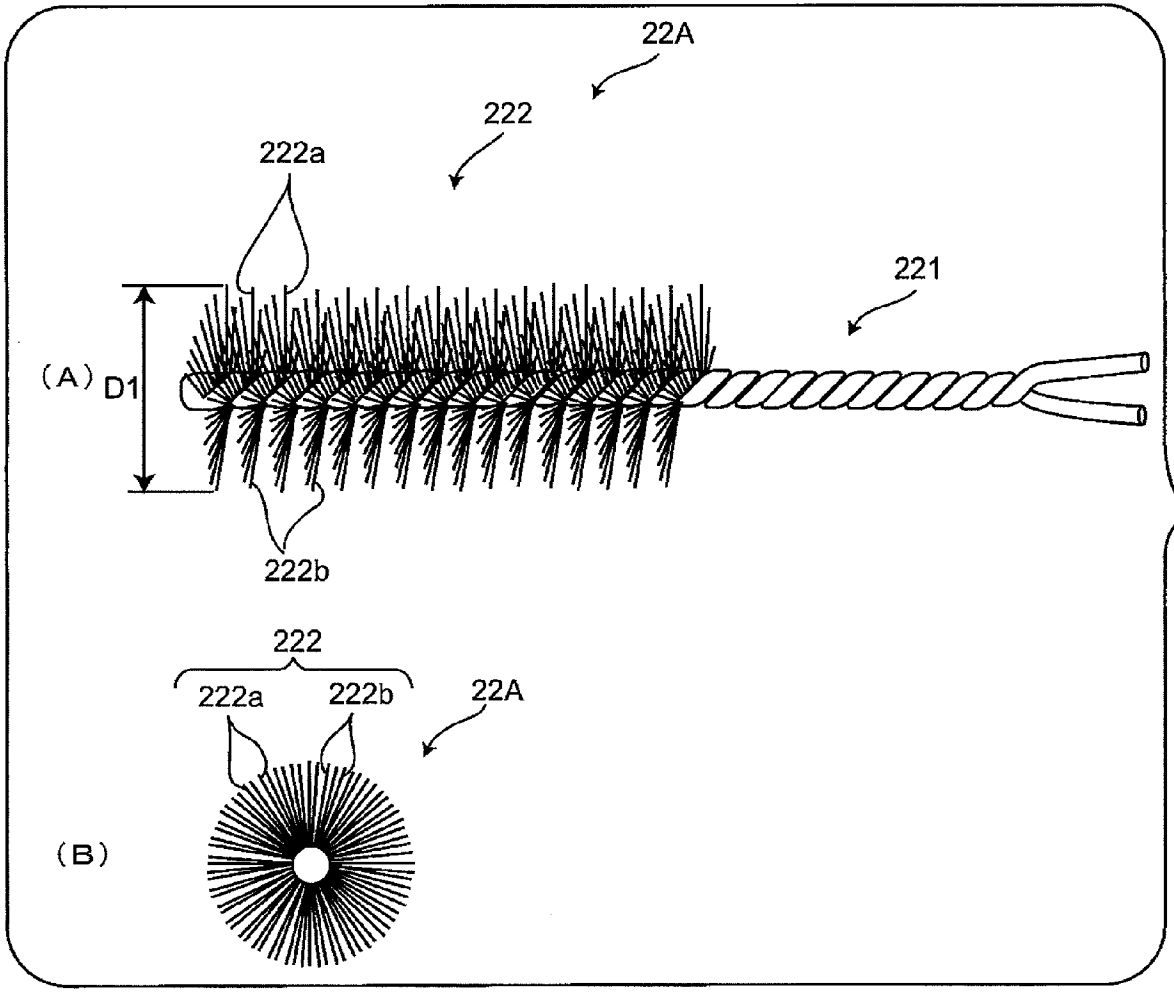
FIG. 3 is an enlarged view illustrating a mascara brush fixed to a tip of a shaft of the cap in a manufacturing stage.

FIG. 3 is an enlarged view illustrating a mascara brush fixed to a tip of a shaft of the cap in a manufacturing stage. Here, part (A) of FIG. 3 is a side view, and part (B) of FIG. 3 is a schematic view viewed from a left side of the part (A) of FIG. 3.

Here, a brush in the middle of manufacturing illustrated in FIG. 3 is referred to as a brush 22A.

The brush 22A includes a core member 221 which extends linearly, many brush bristles 222 which are fixed to the core member 221 and extend radially from the core member 221. Here, the brush bristles 222 form a columnar shape as a whole. The diameter is referred to as D1.

The core member 221 of the brush 22A is formed by two pieces of metal wires which are twisted with each other. The brush bristles 222 are aligned between the two pieces of metal wires before being twisted and are held by the two pieces of metal wires, and then, in this state, the two pieces of metal wires are twisted. Thus, the brush bristles 222 are fixed to the core member 221 in a state in which the brush bristles 222 are arranged in a spiral manner around the core member 221 formed by the two pieces of metal wires in the twisted state.

Here, the brush bristles of the brush 22A include many first brush bristles 222*a* many second brush bristles 222*b* which are cut in lengths same with each other. The first brush bristles 222*a* and the second brush bristles 222*b* may not be distinguished form each other in FIG. 3.

The many first brush bristles 222*a* and many second brush bristles 222*b* are sufficiently mixed with each other in a random manner such that an area where brush bristles included in either ones of the first brush bristles 222*a* and the second brush bristles 222*b* are concentrated does not appear.

Here, the second brush bristles 222*b* have softening point temperatures lower than those of the first brush bristles 222*a*, and the second brush bristles 222*b* are bent and are subjected to an environment of temperature in which the temperature is higher than the softening point temperatures of the second brush bristles 222*b* and lower than the softening point temperatures of the first brush bristles 222*a*, and subsequently, the temperature is returned to an ordinary temperature and then a force for bending is released. Then, as for the first brush bristles, since the environment of temperature has been always lower than the softening point temperatures of the first brush bristles 222*a*, the first brush bristles 222*a* return to the original shape in which the first brush bristles 222*a* linearly extend, and, as for the second brush bristles, since the environment of temperature has exceeded the softening point temperatures of the second brush bristles 222*b*, the second brush bristles 222*b* become shapes in which the second brush bristles 222*b* remain bent. In the manufacturing, materials having respective softening point temperatures which are sufficiently separated from each other are respectively used for the first brush bristles and the second brush bristles, and thereby, a considerably large temperature changing range is allowed as a temperature which is adjusted for bending the second brush bristles 222*b*, and a considerably large changing range also is allowed for the duration of subjecting to the environment of the temperature. Accordingly, it is easy to perform temperature control and duration control, and this is suitable for manufacturing.

Here, as one example, for the first brush bristles 222*a*, fluorine-based resin such as PFA (chemical name: Tetrafluoroethylene/Perfluoalkylvinylether Copolymer) are adopted, and for the second brush bristles 222*b*, PA (Polyamide) or PBT (Polybutylene Terephthalate) and the like are adopted. A softening temperature of PFA is around 260 degree centigrade as an example. A softening temperature of PA is around 100 degree centigrade as an example. Thus, in this case, the brush bristles are bent and are subjected to, for example, a temperature environment of about 120 degree centigrade through 180 degree centigrade, so that it is possible to bent only the second brush bristles 222*b* (PA).

Figure 4:
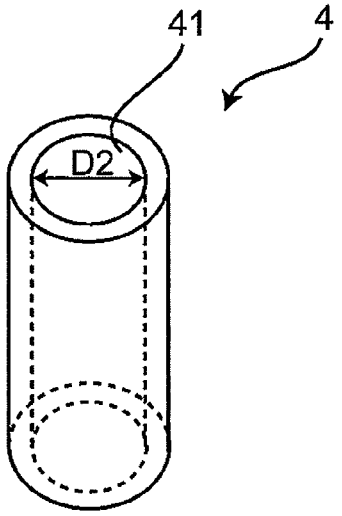
FIG. 4 is a view illustrating a first example of a heater used for bending.

FIG. 4 is a view illustrating a first example of a heater used for bending.

The heater 4 has a cylindrical shape, and has a configuration in which an inner wall surface 41 of the cylindrical shape is heated. The brush 22 illustrated in FIG. 3 is inserted into the heater 4. Here, An inner diameter D2 of the inner wall 41 of the heater 4 is smaller than the diameter D1 of the brush 22 illustrated in FIG. 3. Thus, when the brush 22 illustrated in FIG. 3 is inserted into the heater 4, tips of the brush bristles 222 become a state of being bent. In this state, the brush bristles 222 are heated by the heater 4. A temperature of the heating is lower than the softening point temperatures of the first brush bristles 222*a*, and is equivalent to a softening point temperature of the second brush bristles 222*b* or more. The temperature is maintained until the second brush bristles 222*b* are sufficiently softened. Then, the heater 4 is turned off, and after the temperature decreases down close to an ordinary temperature, the brush 22 is taken out of the heater 4.

Figure 5:
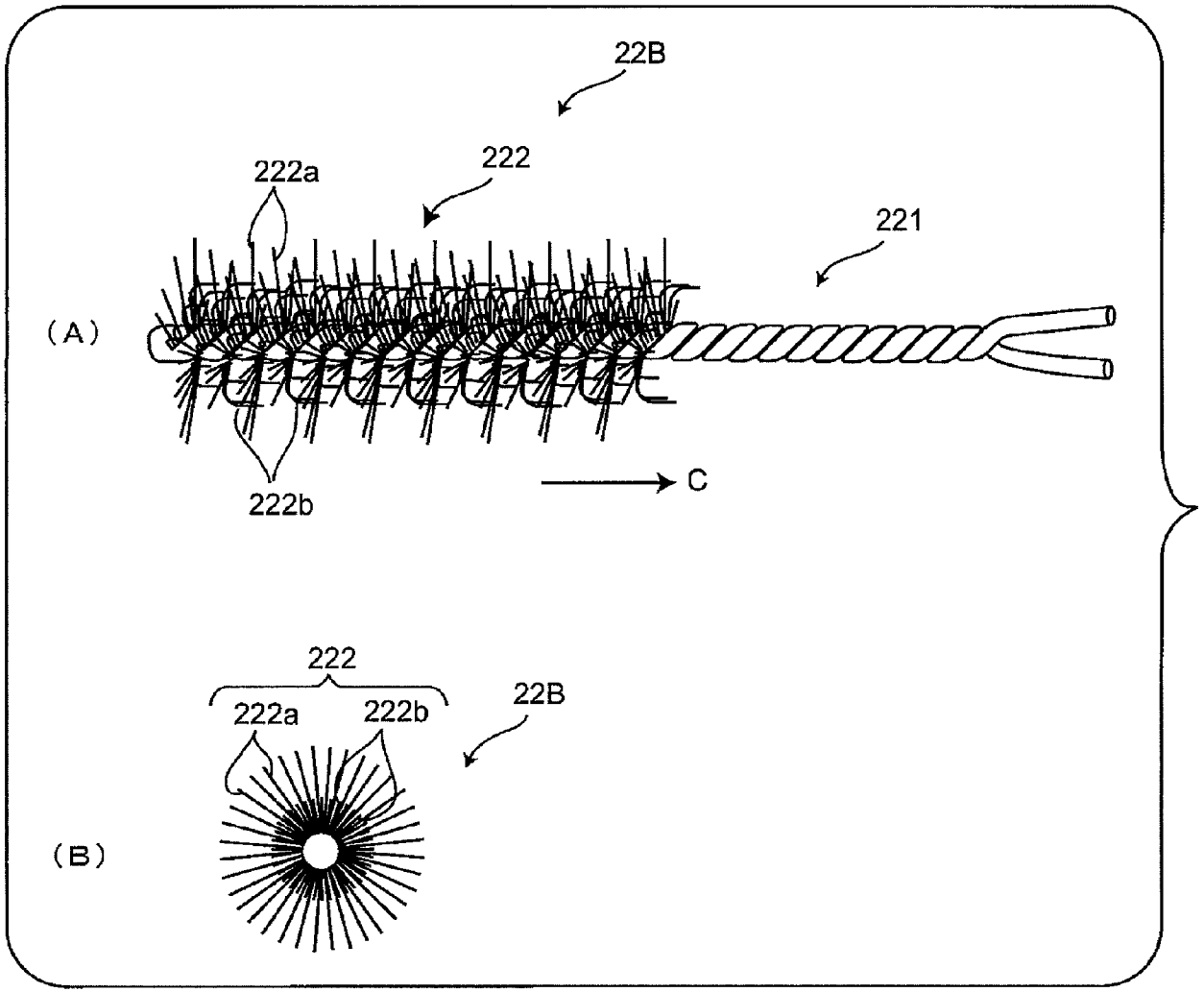
FIG. 5 is a schematic view of a first example of a brush after taken out from the heater.

FIG. 5 is a schematic view of a first example of a brush after taken out from the heater.

When being inserted into the heater 4, the brush bristles 222 are bent backward in an insertion direction. For this reason, the second brush bristles 222*b* of a brush 22B after being taken out of the heater 4 are in a state of being bent backward in the insertion direction (the direction indicated by the arrow C illustrated in part (A) of FIG. 5). However, the first brush bristles 222*a* return to the original shapes extending radially with respect to the core member 221.

The brush 22B having the shape illustrated in FIG. 5 is adapted as a mascara brush for the mascara applicator 1, and thus, the liquid retainability is increased by the second brush bristles 222*b* which are bent. In addition, the brush bristles 222*a* extend radially, and so, the eyelashes are allowed to enter deep the brush and are caught between the brush bristles 222*a* extending radially and the second brush bristles 222*b* being bent and thus extending in directions (the directions indicated by the arrow C) different from the directions in which the first brush bristles 222*a* extend, and thus, the eyelashes are hardly lost from there, providing the sufficient catch-up feel, and it is possible to obtain the sufficient volume-up effect for the eyelashes.

Figure 6:
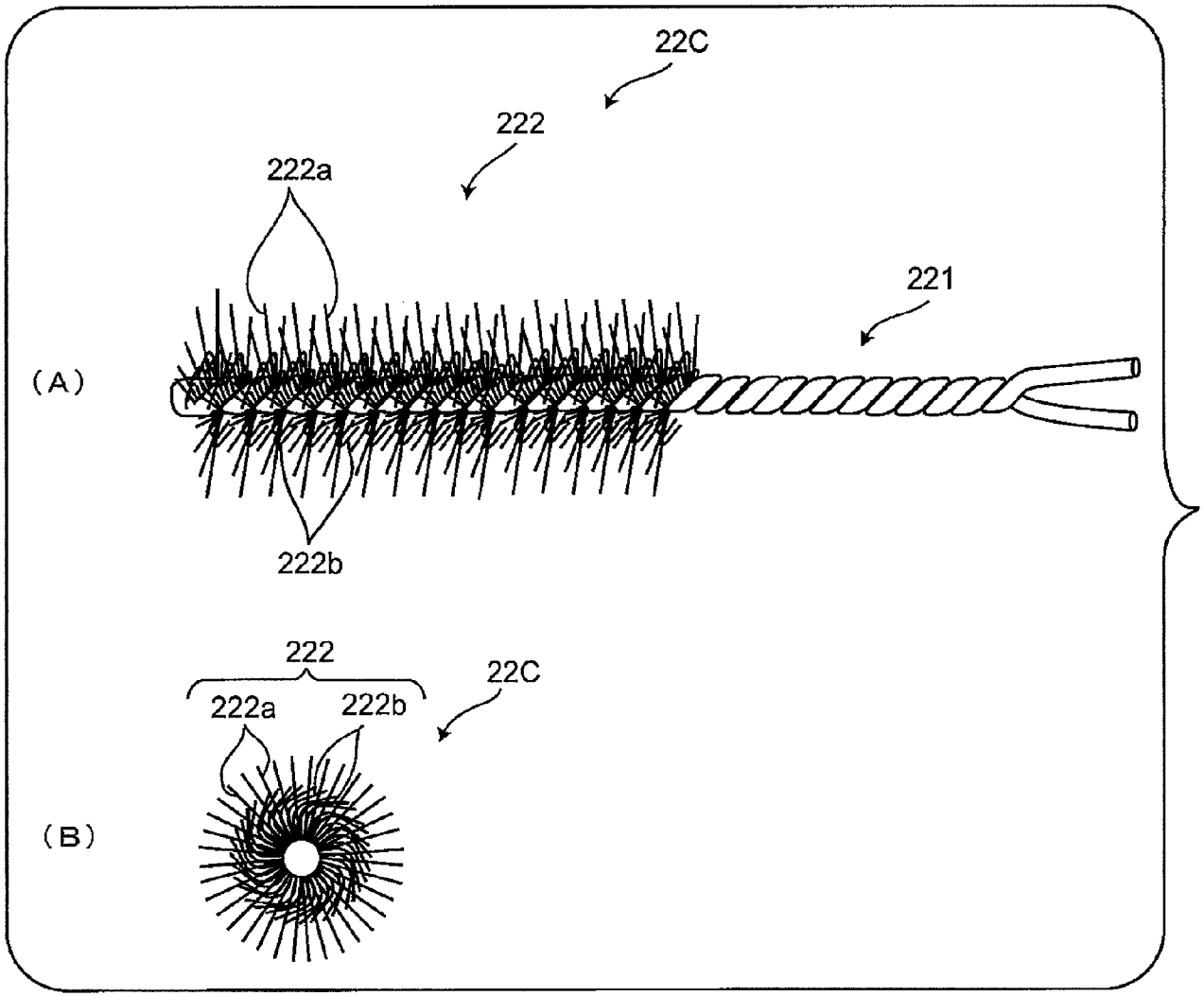
FIG. 6 is a schematic view of a second example of a brush after taken out from the heater.

FIG. 6 is a schematic view of a second example of a brush after taken out from the heater.

Here, the brush 22A in the stage illustrated in FIG. 3 is rotated around the core member 221 while being inserted in the theater 4 illustrated in FIG. 4. Upon this, the brush 222 are bent in directions encircling around the core member 221. After that, by a manner similar to that of the manufacturing of the brush of the first example illustrated in FIG. 5, a brush 22C illustrated in FIG. 6 is manufactured to be used as the brush 22 for the mascara applicator illustrated in FIGS. 1 and 2.

As illustrated in FIG. 6, the second brush bristles 222*b* may be also bent in circumferential directions encircling around the core member 221.

Figure 7:
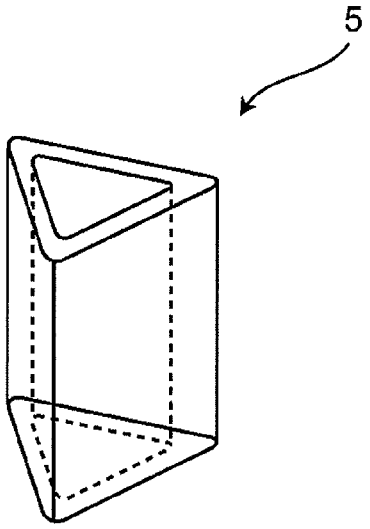
FIG. 7 is a view illustrating a second example of a heater used for bending.

FIG. 7 is a view illustrating a second example of a heater for bending.

The heater 5 has an approximately triangle cylindrical shape. When the brush 22A illustrated in FIG. 5 is inserted into the heater 5, the brush bristles 222 are bent in three areas in the circumferential directions encircling the core member 221, areas in which the brush bristles 222 still extend linearly without being bent remain between the three areas in which those brush bristles 222 are bent. When being heated by the heater 5 in this state, a brush in which the second brush bristles 222*b* are bent in the three areas in the circumferential directions is manufactured.

Figure 8:
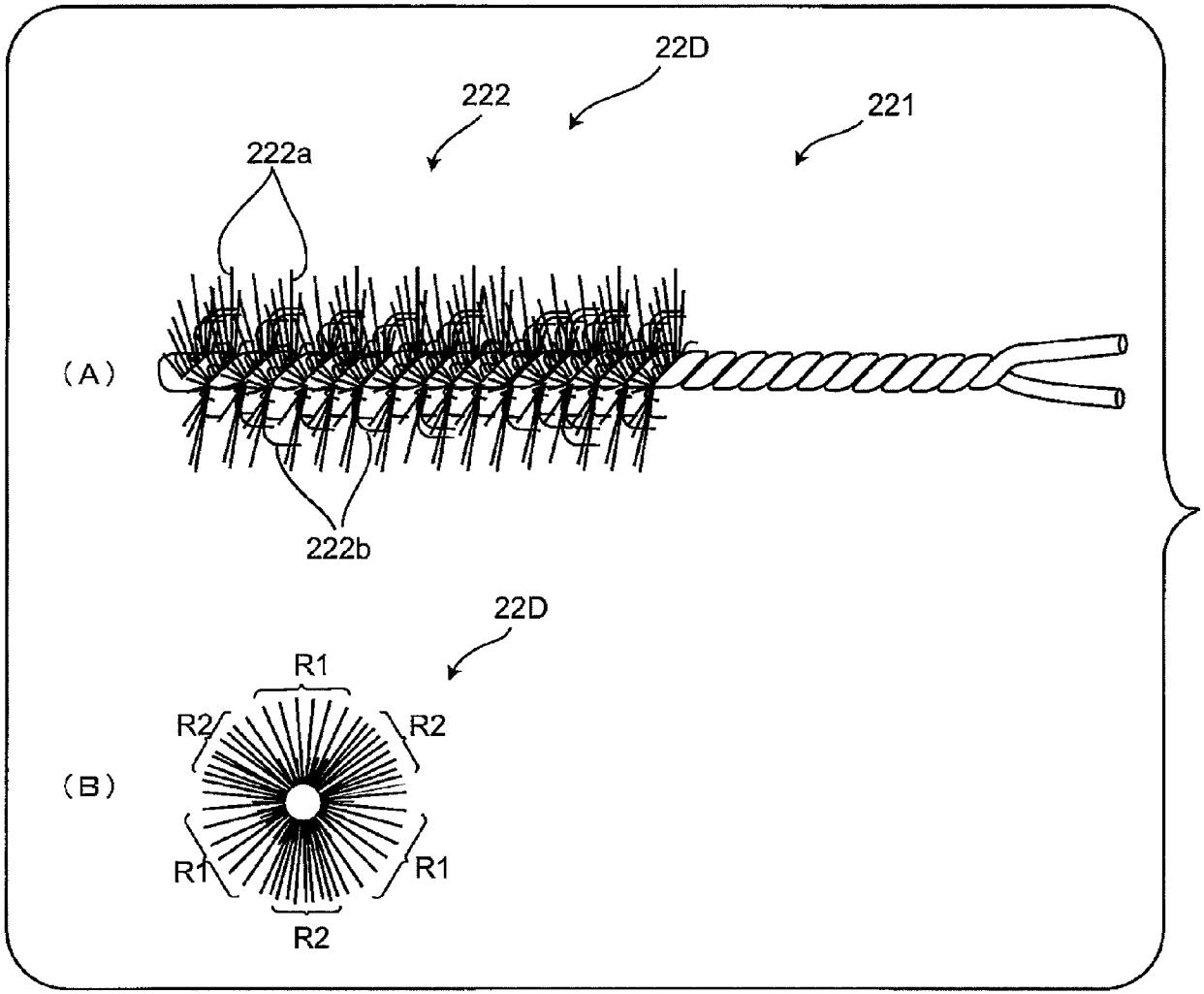
FIG. 8 is a schematic view illustrating an example of a brush manufactured by using the heater illustrated in FIG. 7.

FIG. 8 is a schematic view illustrating an example of a brush manufactured by using the heater illustrated in FIG. 7.

In a brush 22D illustrated in FIG. 8, the second brush bristles 222*b* are bent in the three areas in the circumferential directions encircling around the core member 221, and the second brush bristles 222*b* extend radially together with the first brush bristles 222*a* in the other areas excluding the three areas.

As for the brush 22D illustrated in FIG. 8, in areas R1 in which the first brush bristles 222*a* extend radially and the second brush bristles 222*b* are bent, both of the liquid retainability and the catch-up feel are obtained across all over the areas R1. Areas R2 in which the first brush bristles 222*a* and the second brush bristles 222*b* extend radially are used, for example, for a purpose of sweeping the eyelashes. Or, the areas R2 in which the first brush bristles 222*a* and the second brush bristles 222*b* extend radially may be used as areas for allowing the eyelashes to enter further deep.

As illustrated in this example, a part of the second brush bristles 222*b* may be allowed to extend radially without being bent.

Here, how away positions are from the core member where the second brush bristles 222*b* are to be bent, in which direction the second brush bristles 222*b* are bent, or whether only a part or all of the second brush bristles 222*b* are bent relate to the viscosity of the mascara liquid, and are adjusted based on design principles such as adjusting the liquid retainability and what extent the catch-up feel is provided to.

Incidentally, here, it has been described with reference to FIG. 3 that the first brush bristles 222*a* and the second brush bristles 222*b* are cut in the lengths same with each other. However, these brush bristles are not necessarily cut in same lengths, and may be allowed to be in lengths different from each other for adjusting the liquid retainability and the catch-up feel. The same things applies to the thicknesses of the first brush bristles 222*a* and the second brush bristles 222*b*.

In addition, the brushes having the shapes illustrated in FIGS. 5, 6 and 8 have been exemplified. However, the mascara brush according to the present invention is not limited to these shapes. The present invention also includes brushes having various shapes in which, by bending the second brush bristles, the liquid retainability, the catch-up feel and the like are adjusted.

REFERENCE SIGNS LIST

1 Mascara Applicator
2 Cap
3 Case
4, 5 Heater
20 Cap Main Body
21 Shaft
22, 22A, 22B, 22C, 22D Brush
23 Female Screw
31 Case Main Body
32 Squeezing Member
41 Inner Wall Surface
221 Core Member
222 Brush Bristle
222*a* First Brush Bristle
222*b* Second Brush Bristle
311 Opening Section
311*a* Opening
311*b* Male Screw

What is claimed is:

1. A mascara brush comprising:

a core member;

a first plurality of brush bristles which are fixed to the core member and radially extend from the core member; and a second plurality of brush bristles each of which has a softening point temperature lower than that of each of the first plurality of brush bristles, said second plurality of bristles being fixed to the core member to be mixed with the first plurality of the brush bristles, and which include at least a portion radially extending up to intermediate points thereof from the core member and bending at intermediate positions thereof to form heat treated curved bristles from undergoing heating at the lower softening point, and wherein the first plurality of bristles are heat-treated and have a substantially straight configuration after undergoing heating at the lower softening point, and wherein the heat-treated first plurality of bristles and the heat-treated second plurality of bristles do not melt from undergoing heating at the lower softening point, and each of the first plurality of bristles and the second plurality of bristles have an unchanged length before undergoing heating and after undergoing heating.

2. The mascara brush according to claim 1, wherein the first plurality of the brush bristles are made of fluorine-based resin.

3. The mascara brush according to claim 1, wherein the second plurality of brush bristles are made of polyamide or polybutylene terephthalate.

4. The mascara brush according to claim 1, wherein the plurality of second bristles have substantially a same cut length as the plurality of first bristles, after the plurality of second bristles are exposed to heating at the lower softening point.

5. The mascara brush according to claim 1, wherein the first plurality of bristles and the second plurality of bristles have different cut lengths, and lengths of the second plurality of bristles does not change after the plurality of second bristles are exposed to heating at the lower softening point.

6. A manufacturing method of mascara brush, comprising:

a first step including fixing to a core member a first plurality of brush bristles and a second plurality of brush bristles each having a softening point temperature lower than that of each of the first plurality of brush bristles such that the first plurality of brush bristles and the second plurality of brush bristles are mixed with each other and the first plurality of brush bristles and the second plurality of brush bristles radially extend; and a second step including, while bending at least a partial area in a circumferential direction encircling around the core member of the first plurality of brush bristles and the second plurality of brush bristles at intermediate positions, subjecting the first plurality of brush bristles and the second plurality of brush bristles to an atmosphere of a heat-treatment temperature which is lower than the softening point temperature of each of the first plurality of brush bristles and higher than the softening point temperature of each of the plurality of second brush bristles, wherein the subjecting the second plurality of brush bristles to the heat treatment temperature causes curling deformation of the second plurality of brush bristles without reducing a length of the second plurality of brush bristles from before heating, and further wherein subjecting the first plurality of brush bristles to the heat-treatment temperature leaves the first plurality of bristles straight and without reducing a length of the first plurality of brush bristles from before heat-treatment.

7. The manufacturing method according to claim 6, wherein the first step includes holding the first plurality of brush bristles and the second plurality of brush bristles between two pieces of wires in a state in which the first plurality of brush bristles and the second plurality of brush bristles are mixed and aligned in parallel, and twisting the two pieces of wires to fix the first plurality of brush bristles and the second plurality of brush bristles in a spiral arrangement around the core member formed by the two pieces of wires in the twisted state.

* * * * *